United States Patent [19]

Post

[11] Patent Number: 4,457,232

[45] Date of Patent: Jul. 3, 1984

[54] ARTILLERY FUZE FOR PRACTICE AND TACTICAL MUNITIONS

[75] Inventor: Lloyd D. Post, Randolph, N.J.

[73] Assignee: The United States of America as represented by the Secretary of the Army, Washington, D.C.

[21] Appl. No.: 454,944

[22] Filed: Jan. 3, 1983

[51] Int. Cl.[3] ..... F42C 15/26

[52] U.S. Cl. ..... 102/233; 102/235; 102/236; 102/249

[58] Field of Search ..... 102/231, 232, 233, 235, 102/236, 242, 245, 248, 249, 251, 253, 237, 239, 221, 222

[56] References Cited

U.S. PATENT DOCUMENTS

| | | | |
|---|---|---|---|
| 1,837,800 | 12/1931 | Utter | 102/242 |
| 2,436,385 | 2/1948 | Gillette et al. | 102/235 |
| 2,465,395 | 3/1949 | O'Rear | 102/242 |
| 2,951,444 | 9/1960 | Hunt et al. | 102/248 |
| 4,007,689 | 2/1977 | Apothéloz | 102/251 |
| 4,128,061 | 12/1978 | Kaiser | 102/249 |
| 4,217,828 | 8/1980 | Pelousse | 102/249 |
| 4,421,031 | 12/1983 | Carter et al. | 102/222 X |

*Primary Examiner*—David H. Brown

*Attorney, Agent, or Firm*—Robert P. Gibson; Anthony T. Lane; Harold H. Card, Jr.

[57] ABSTRACT

A fuze includes a conically shaped body having a central longitudinal channel communicating with a rearward central chamber, a firing pin assembly containing a primary and a biased secondary firing pin disposed in the channel, a delay arming assembly disposed in the chamber, a sleeve containing a setback locking assembly disposed in chamber, and a pyrotechnic smoke cartridge located in the hollow of the sleeve. The arming assembly contains two V-shaped pivotable levers held in the safe position by the secondary firing pin extending into a hole in each lever and by a detent pin extending into a hole in the lower lever, each lever having a hole containing a firing ball. On firing the projectile from the gun, the biased detent pin is withdrawn by setback force and the detents on the secondary firing pin are withdrawn by centrifugal force, releasing both levers to pivot by centrifugal force and align the firing balls with the firing pins and the cartridge primer. On ground impact the crush cap collapses, driving the primary firing pin into the secondary firing pin, which impacts the firing balls striking the primer.

6 Claims, 4 Drawing Figures

REAR ARMING LEVER SHOWN
ROTATED TO ARMED POSITION

BOTH ARMING LEVERS SHOWN
IN ARMED POSITION

ARTILLERY FUZE FOR PRACTICE AND TACTICAL MUNITIONS

GOVERNMENT RIGHTS

The invention described herein may be manufactured, used and licensed by the Government for Government purposes without the payment to me of any royalties thereon.

BACKGROUND OF THE INVENTION

This invention relates to a novel fuze assembly suitable for use in practice and/or tactical type artillery and rotated mortar munitions.

Prior methods of using smoke cartridges for training of personnel in handling and firing of artillery (including mortar) munitions employed inertially responsive mechanisms, wherein the smoke cartridge moved forward to strike the firing pin on impact of the projectile with the ground. In another version, the cartridge was initiated by a flash detonator in the forward part of the fuze. However, the inertial system and the flash output were both too slow and permitted the projectile to bury itself in the ground or other impact medium, so that most of the smoke signature products were smothered before they could be ejected.

Current practice is to employ training rounds using expensive, out-of-line tactical fuzes normally used in high explosive munitions, to achieve the desired field effect, rendering them expensive and presenting a hazardous situation if the item is a field dud.

SUMMARY OF THE INVENTION

An object of the present invention is to provide a simple, inexpensive, in-line training fuze for practice munitions using a pyrotechnic smoke cartridge, which avoids the adaptation of the more costly out-of-line tactical type fuzes.

Another object is to provide a simple, inexpensive in-line fuze containing a delay arming system suitable for use in tactical or practice munitions.

A further object is to provide a fuze employing a standard shot-gun type cartridge, which is loaded with a suitable pyrotechnic or smoke-producing composition and contains a primer located adjacent to said composition so as to provide a faster reaction and deployment of smoke compared to initiation by a flash detonator in the forward part of the fuze.

These and other objects are achieved by the novel in-line fuze of the present invention, which includes a casing containing a pyrotechnic composition, such as a smoke cartridge, together with a firing pin assembly and an arming system, which are activated by spin and setback forces to cause alignment of the firing pin and firing balls of the arming system with the cartridge primer.

DETAILED DESCRIPTION OF THE INVENTION

Figure 1:
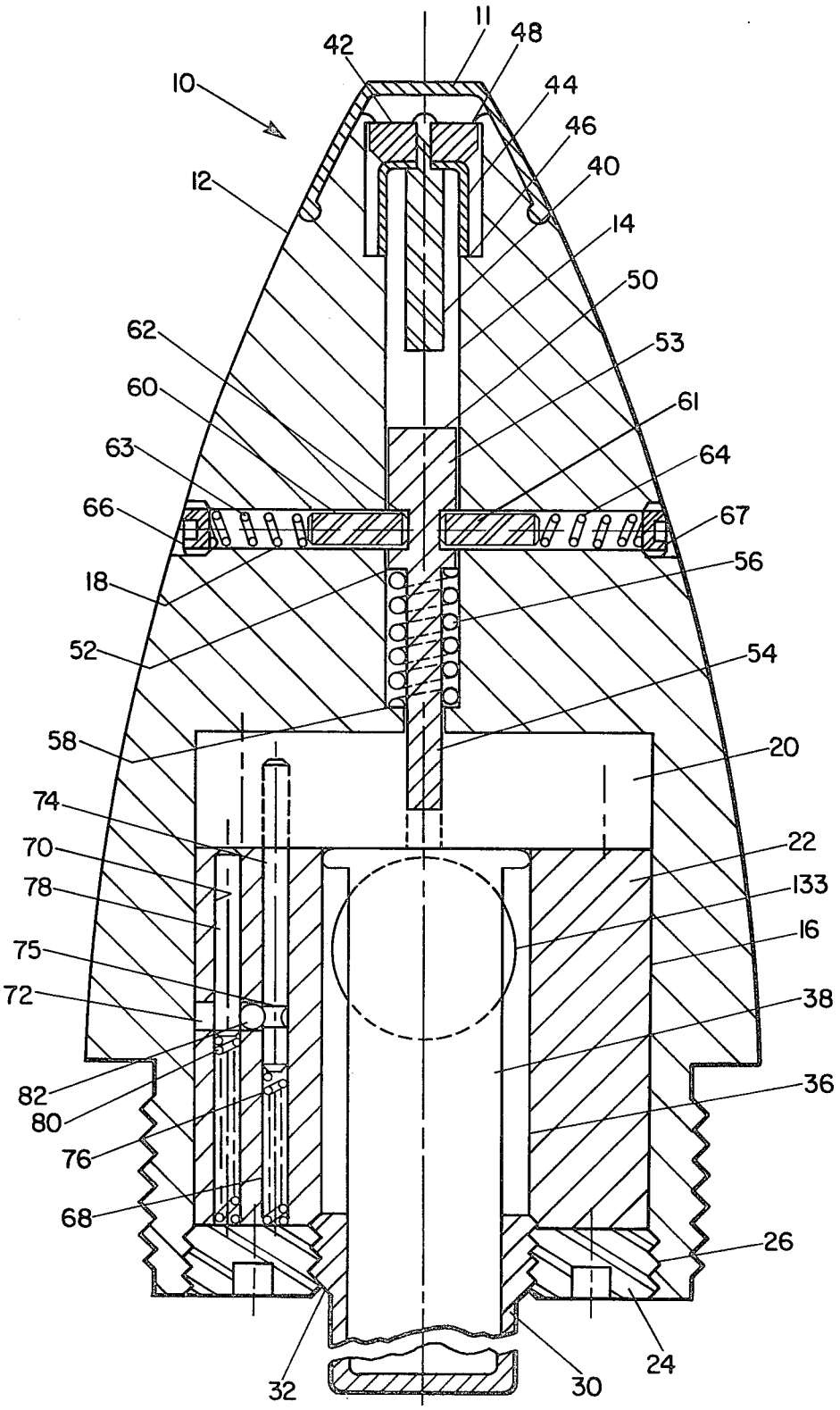
FIG. 1 is a longitudinal view in cross section of a training fuze assembly of the present invention, which employs a simplified detent system.

Referring to FIG. 1, the fuze 10 includes an ogival housing 12, which is provided with a protective cap 11 and may be attached in conventional manner to the warhead of a projectile (not shown). In the forward portion of the housing along the longitudinal axis thereof is positioned a cylindrical channel or bore 14, which communicates with a relatively wide cylindrical chamber 16 in the rearward portion of the housing. The housing also contains a radial or transverse cylindrical channel 18 which intersects channel 14 at right angles. Disposed in chamber 16 adjacent to channel 14 is a cylindrical case 20 containing an arming assembly, followed by an annular sleeve 22 containing a setback assembly. These elements are held in chamber 16 by means of a threaded support ring 24 containing external threads 26, which engage complementary interior threads at the bottom of the fuze housing 12. A cup-shaped plug 30 containing exterior threads 32 is threadably attached to interior threads of the support ring 24, thereby forming a chamber 36 for holding a cartridge 38 containing a smoke composition, explosive train or the like.

In the wide forward part of channel 14 there is disposed a primary striker pin 40, which is held in a disc 42 and bottom of an inverted crusher cup 44, whose open end rests on the shoulder 46 of channel 14. The rim 48 of channel 14 is crimped on the disc 42 to mount the primary striker pin 40 in chamber 14.

In the rearward portion of channel 14 there is disposed a secondary striker pin 50 having an annular shoulder 52 separating a wide forward cylindrical portion 53 from a reduced cylindrical portion 54. The secondary striker pin is biased toward the primary striker pin by a compression spring 56 positioned between shoulder 52 and an annular shoulder 58 near the rear of channel 14. In the transverse channel 18 are disposed detent pins 60 and 61 for holding the secondary striker pin 50. These pins are biased inward into the annular groove 62 of secondary striker pin 50 by compression springs 63 and 64 retained by closure screws 66 and 67.

The sleeve 22 is provided with longitudinal cylindrical channels or bores 68 and 70 and a radial cylindrical channel or bore 72, which intersects channels 68 and 70 at right angles. In channel 68 there are positioned a detent pin 74 containing an annular groove 75 for locking the rear arming lever described below, and a compression spring 76 for biasing said pin forward. Disposed in channel 70 are a setback pin 78 for locking the detent pin and a compression spring 80 for biasing the setback pin forward. The radial channel 72 contains a locking ball 82. The setback pin locks the detent pin by holding the locking ball in groove 75.

Figure 2:
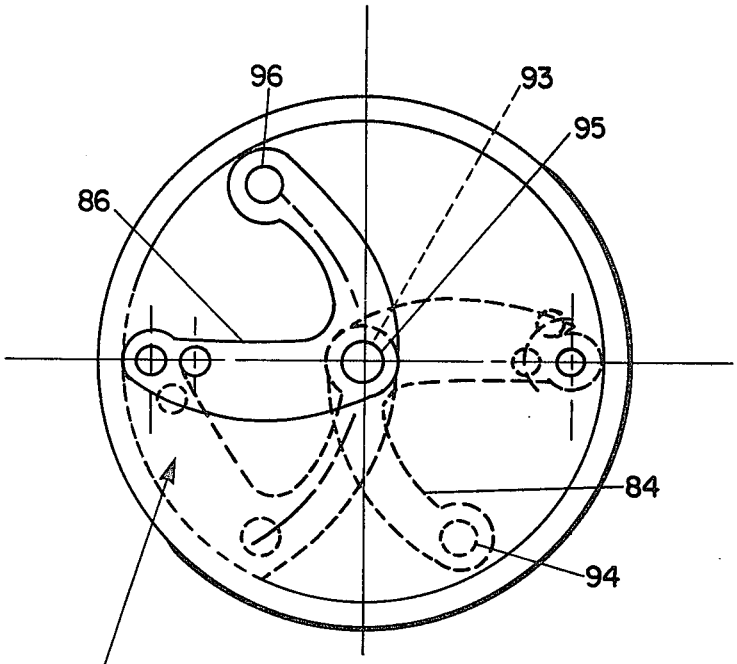
FIG. 2 is a view of the arming assembly along line A—A of FIG. 3 showing the rear arming lever rotated to the armed position.
Figure 3:
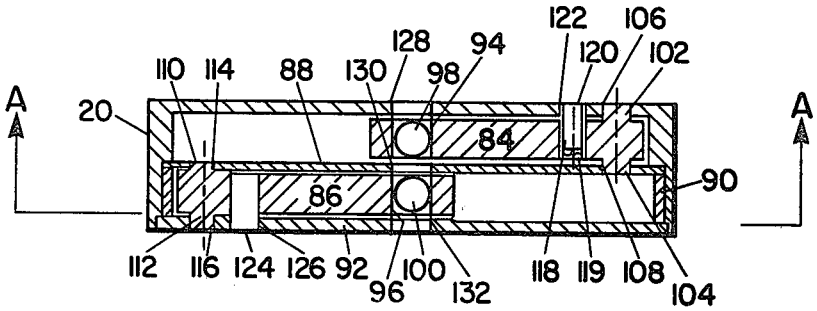
FIG. 3 is a cross-sectional view of the arming assembly showing both arming levers rotated to armed position.

As seen in FIGS. 2 and 3, the arming assembly in case 20 includes a forward arming lever 84 and a rearward arming lever 86, a support plate 88 for supporting said levers, and a ring-like spacer 90 for separating the support plate from the case cover plate 92. Both forward and rear arming levers are V-shaped and contain vertex or axial holes 93 and 95 respectively, which receive the reduced portion 54 of the secondary striker pin to lock the levers in the safe mode. Further, the levers have holes 94 and 96 containing firing balls 98 and 100 respectively, which provide a link between the secondary striker pin and the explosive cartridge 38 when the levers are rotated to the armed position. The forward arming lever 84 turns on pivot projections 102 and 104 received in holes 106 and 108 in the case and support plate, respectively, while the rear arming lever 86 turns on pivot projections 110 and 112 received in holes 114 and 116 in the support plate and cover plate, respectively. The forward arming lever 84 has a recess 118 containing a spring 119 biased locking pin 120, which enters a complementary recess 122 in the case when the hole 94 is aligned with the secondary striker pin 50, thereby locking the front arming lever in the armed position. The rear arming lever 86 has a recess 124, which in the safe position is aligned with a complementary hole 126 in cover plate 92 for receiving detent pin 74. Case 20, support plate 88 and cover plate 92 contain central holes 128, 130 and 132 respectively for accommodating the reduced portion 54 of the secondary striker.

The fuze operates as follows:

When the projectile containing fuze 10 is fired from the gun, setback acceleration force causes the setback pin 78 to move rearward, compressing setback spring 80 until the forward end has cleared radial channel 72, thereby permitting locking ball 82 to be moved radially outward by the camming force of the detent pin groove 75. After the ball has cleared this groove, the detent pin 74 moves rearward under the setback force, compressing the detent pin spring 76 and withdrawing from the rear arming lever 86 to permit the lever to rotate in response to centrifugal force.

After setback force has dissipated to a low level and spin forces have increased, detent pins 60 and 61 move radially outward, compressing springs 63 and 64. When the ends of the detent pins have withdrawn from the groove 62 in the secondary striker pin 50, compression spring 56 moves the secondary striker pin 50 into contact with the primary firing pin 40, which permits the reduced portion 54 of the secondary striker pin to withdraw from holes 93 and 95 in the front and rear arming levers, respectively.

Continued spin forces cause the front arming lever 84 to rotate in an arc about pivot 102/104 due to centrifugal force acting at the center of gravity of said lever. This motion carries the firing ball 98 into a central fuze alignment wherein the front arming lever locking pin 120 is forced by spring 119 into recess 122 in the case 20. Creep or deceleration forces will cause both firing ball 98 and locking pin 120 to anchor the forward arming lever 84 into their corresponding nests, thereby preventing the lever from disarming due to spurious forces which may be encountered during flight or impact.

The rear arming lever 86 arms in much the same manner as the front arming lever 84, the primary difference being in the manner of locking the lever in the armed position. When the setback force ceases, detent pin 74 is moved forward by the force of spring 76. At this time the rear arming lever 86 has rotated outward to the armed position so that the forward end of the detent pin 74 can move alongside the edge of said lever, blocking any possible return rotation thereof. This completes the arming of the fuze by having both firing balls 98 and 100 in alignment with the secondary striker pin 50.

On target impact cup 44 collapses, driving the primary striker pin into the secondary striker pin, which via firing balls 98 and 100 impacts and initiates the primer portion of the smoke cartridge 38, or an explosive train in a tactical version of the fuze. For a training fuze the smoke/flash products can be exited through flash holes 133, shown in phantom in FIG. 1, or from exhaust ports to the rear of the assembled projectile.

Figure 4:
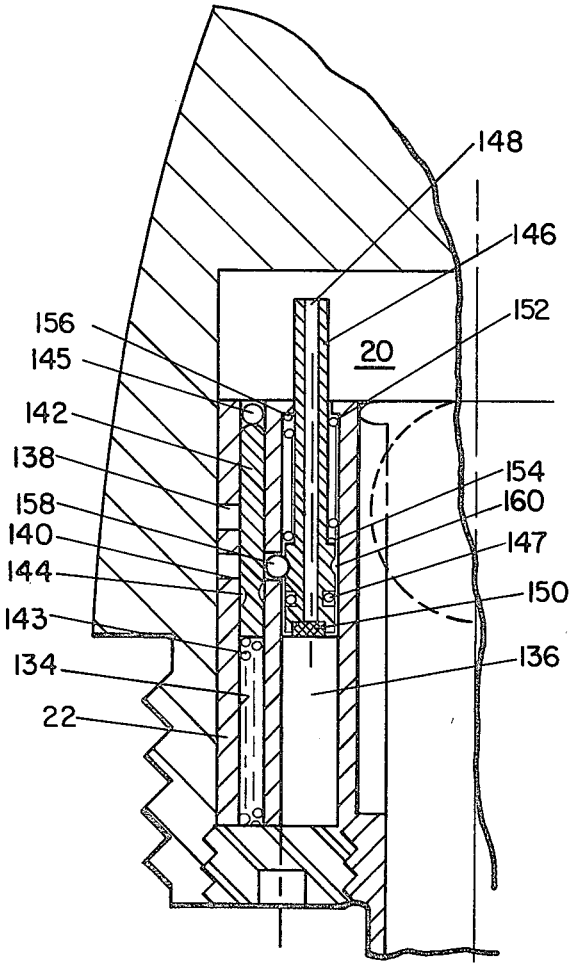
FIG. 4 is a view of a delay arming modification of a fuze assembly of the present invention which can be used as a tactical fuze or as a training fuze.

FIG. 4 shows a suitable modification of the fuze to provide a delay arming system. In this modification, the annular sleeve 22 contains longitudinal channels or bores 134 and 136 and radial channels or bores 138 and 140. Channel 134 contains a setback pin 142 forwardly biased by a spring 143 and a positioning ball 145 trapped between the forward end of said pin and the cover plate 92 of case 20 containing the arming assembly. Channel 136 contains a detent piston 146, which projects into a recess (corresponding to number 124 in FIG. 3) in the rear arming lever 86 for locking the rear arming lever. The detent piston possesses an O-ring seal 147, a central passage 148 closed by a porous plug 150, and is rearwardly biased by a spring 152 positioned between piston shoulder 154 and channel shoulder 156. Radial channel 140 contains a locking ball 158 for locking the detent piston. The locking ball is held in annular groove 160 of the piston by locking pin 142 in the safe mode shown in FIG. 4. Radial channel 138 is a relief chamber for receiving positioning ball 145.

In operation, setback force causes setback pin 142 and positioning ball 145 to move rearward against spring 143 until the ball can move into relief chamber 138 by the action of spin force. After setback ceases, the setback pin is biased by spring 143 to a more forward position than before due to removal of ball 145 from in front of the pin. This action aligns the annular groove 144 in the rear portion of setback pin 142 with locking ball 158, which is then cammed radially outward from groove 160 into groove 144 of the setback pin by force of the detent piston spring 152, thereby permitting the detent piston to be biased rearward by said spring and gradually withdraw from and unlock the rearward lever 86. This rearward movement is retarded by the entrapped air in channel 136 behind the detent piston, which is metered through the porous plug 150 and central passage 148 into the space beyond, thereby delaying the arming motion of the rear arming lever.

The delayed arming detent system described above may also be employed in the training version, although it is probably unnecessary in view of the relatively low hazard of the pyrotechnic smoke cartridge.

The foregoing disclosure and drawings are merely illustrative of the principles of this invention and are not to be interpreted in a limiting sense. I wish it to be understood that I do not desire to be limited to the exact details of construction shown and described because obvious modifications will occur to a person skilled in the art.

I claim:

1. An artillery impact fuze for practice or tactical munitions comprising:

a conically shaped body having a forward central longitudinal channel communicating with a rearward central chamber;

a firing pin assembly disposed in said channel, said firing pin assembly including a primary striker pin, a spring biased secondary striker pin in spaced apart relation rearward of said primary striker pin, and detent means for holding said secondary striker pin to project into a hole in each lever of the arming assembly, said detent means being responsive to centrifugal force to free said secondary striker pin to withdraw from said arming lever holes;

an arming assembly disposed in said chamber rearward of said firing pin assembly, said arming assembly including a forward rotatable lever containing a first hole for receiving said secondary striker pin and a second hole containing a firing ball; and a rearward rotatable lever containing a first hole for receiving said secondary striker pin, a second hole containing a firing ball and a third hole for receiving a detent pin of the setback assembly; each lever containing a pivot means, which after withdrawal of said pins from said holes, permits rotation of the lever in response to centrifugal force to the armed position, wherein said firing balls are aligned with said striker pin;

a setback assembly disposed in said chamber rearward of said arming assembly, said setback assembly including a first longitudinal channel, a second longitudinal channel, a radial channel connecting said first and second channels, a setback pin and compression spring disposed in said first channel, a detent pin containing an annular groove and a compression spring disposed in said second channel, and a locking ball disposed in the radial channel between said pins and extending into the annular groove for holding the detent pin in said hole in the rear arming lever, said setback pin being responsive to setback force to move rearward to free said locking ball and thereby permit the detent pin to withdraw from from said hole in the rear arming lever; and an explosive composition including a primer disposed in the chamber rearward of the arming assembly, said composition being ignited by impact of the firing balls with said primer by axial movement of the first and second striker pins, the firing balls being placed in axial alignment with the primer and the firing pins by movement of the arming levers of said arming assembly.

2. A fuze according to claim 1, wherein the detent means for said secondary striker pin includes an annular groove in said pin, a radial channel intersecting said longitudinal channel, and spring-biased detent pins disposed in said radial channel, said pins extending into said annular groove and being responsive to centrifugal force to withdraw from said groove and thereby free the secondary striker pin to withdraw and unlock the forward lever.

3. A fuze according to claim according to claim 1, wherein said detent pin, after cessation of setback force and rotation of the rear lever to the armed position, is biased forward by said spring to alongside said lever, thereby locking the lever in the armed position.

4. A fuze according to claim 1, wherein the setback locking assembly is housed in a sleeve body disposed in said rearward central chamber and the explosive composition including primer is disposed in the hollow of said sleeve.

5. A fuze according to claim 1, wherein said detent pin is a piston containing a longitudinal passage closed by a gas-permeable plug means, and said spring biases said piston rearward in said second channel, the rearward movement and withdrawl of the piston from the rear arming lever recess being retarded by the metering of the air in said channel through said gas permeable plug and said passage.

6. A fuze according to claim 5, which further contains a positioning ball disposed in front of the setback pin in said first channel, a lateral chamber for receiving said positioning ball forward of said radial channel and an annular groove in the setback pin for receiving the piston locking ball and thereby freeing said piston for rearward movement and withdrawal from said rear arming lever hole.

* * * * *